United States Patent [19]

Frawley

[11] Patent Number: 5,048,562

[45] Date of Patent: Sep. 17, 1991

[54] ONE WAY AIR ADMITTANCE VALVE

[76] Inventor: Patrick D. Frawley, Pyrmont House, Woodland Avenue, Hartley, Kent, DA3 7BY, United Kingdom

[21] Appl. No.: 529,185

[22] Filed: May 25, 1990

[30] Foreign Application Priority Data

Jun. 6, 1989 [GB] United Kingdom ..... 8913009

[51] Int. Cl.[5] ..... F16K 15/08

[52] U.S. Cl. ..... 137/516.15; 137/526; 4/211

[58] Field of Search ..... 137/526, 516.15; 4/211

[56] References Cited

U.S. PATENT DOCUMENTS

| | | | |
|---|---|---|---|
| 3,923,081 | 12/1975 | Persson | 137/526 X |
| 4,535,807 | 8/1985 | Ericson | 137/526 X |
| 4,867,802 | 9/1989 | Earl | 137/526 |

FOREIGN PATENT DOCUMENTS

| | | | |
|---|---|---|---|
| 305264 | 4/1918 | Fed. Rep. of Germany | 137/533.25 |
| 1170964 | 1/1959 | France | 137/516.15 |
| 482989 | 4/1938 | United Kingdom . | |
| 1187477 | 4/1970 | United Kingdom . | |
| 1433446 | 4/1976 | United Kingdom . | |
| 2073857 | 10/1981 | United Kingdom . | |
| 2112906 | 7/1983 | United Kingdom | 137/526 |
| 2205148 | 11/1988 | United Kingdom . | |

*Primary Examiner*—Robert G. Nilson

*Attorney, Agent, or Firm*—Iandiorio & Dingman

[57] ABSTRACT

A one way air admittance valve (2) for admitting air into a pipe (3), which valve (2) comprises a body portion (4) for fitting to the pipe (3), at least one air inlet port (6) in the body portion (4), and rigid sealing means (16) which is longitudinally movable between a first position in which it seals the air inlet port (6) and a second position in which the air inlet port (6) is open for the admittance of air into the pipe (3), the valve (2) being such that there is only one sealing means (16) for all of the air inlet ports (6), and the sealing means (16) being such that it seals at two separate areas by engaging with a pair of lip seals (18,20) which are mounted on the body portion (4) and which are radially spaced apart by being positioned inwardly and outwardly of of the air inlet port (6).

7 Claims, 3 Drawing Sheets

ONE WAY AIR ADMITTANCE VALVE

This invention relates to a one way air admittance valve and, more especially, this invention relates to a one way air admittance valve for admitting air into a pipe.

One way air admittance valves for admitting air into pipes are known. It is an aim of the present invention to provide a one way admittance valve which is of a different construction to the known valves.

Accordingly, this invention provides a one way air admittance valve for admitting air into a pipe, which valve comprises a body portion for fitting to the pipe, at least one inlet air port in the body portion, and rigid sealing means which is longitudinally movable between a first position in which it seals the air inlet port and a second position in which the air inlet port is open for the admittance of air into the pipe, the valve being such that there is only one sealing means for all of the air inlet ports, the sealing means being such that it seals at two separate areas by engaging with a pair of lip seals which are mounted on the body portion and which are radially spaced apart by being positioned inwardly and outwardly of the air inlet port.

The valve of the present invention may be used on a soil pipe for a water closet, or a waste pipe for a sink or a bath. As the waste material passes along the soil pipe or the water passes along the waste pipe, a vacuum tends to be created which could suck the water from the pipe trap at the bottom of the toilet bowl of the water closet or at the underneath of the sink or the bath. With the valve of the present invention, air is appropriately admitted to stop the sealing water from being sucked out of the water trap, thereby to avoid odours creeping back up the soil pipe or the waste pipe. With a soil pipe, the valve can be used to cap the soil pipe in a bathroom or a loft, and the valve avoids the need to continue the soil pipe upwardly above the roof of the house, flat, office or other structure.

The valve of the present invention may be especially efficient at opening at low pressures, whilst at the same time giving a good seal to stop the passage of smells. The valve may open at 10 mm head of water. The valve may operate to let in a substantial amount of air and this is advantageous in that the valve may be used on pipes in high storey buildings. With some known valves, it is not possible to instal the valves on buildings higher than four storeys.

The valve may be one in which there are three of the inlet ports. Any appropriate and desired number of the inlet ports may be employed.

The inlet ports may be formed between web parts of the body portion. The inlet ports may be formed in a flanged part of the body portion.

The sealing means preferably comprises a sealing disc. Preferably, the sealing disc is substantially flat but it may be concave or convex if desired.

The sealing disc may have peripheral ribs. The ribs may act as friction reducing guides as the sealing disc moves.

The lip seals may each be a lip seal which fits in a groove in the body portion and which projects from the groove inwardly into the body portion. Instead of fitting in grooves, the seals may fit over flanges. In either embodiment, the seals are stationery and the sealing means, for example the sealing disc, moves.

The sealing means may include a guide member for guiding the longitudinal movement of the sealing means.

The guide member may be a guide rod which extends from the sealing means and which runs in an aperture formed in a transverse part of the body portion. Alternatively, the guide member may be a guide rod which extends from a closed end of the body portion of the valve and which extends into a guide bore in the sealing means.

The body portion may have an open top which is closed by a lid. In this case, the lid may be provided with the guide rod for locating in the bore in the piston.

Preferably, the lid is a screw lid which screws to the body portion. Usually, the screw lid will screw over the outside of the body portion but the screw lid may screw to the inside of the body portion if desired.

With a sealing disc and the pair of seals positioned inwardly and outwardly of the inlet port, the lid can be formed to be a flat type of lid which only has to accommodate the movement of the sealing disc.

The or each air inlet port is preferably formed in an outwardly extending flanged part of the body portion.

The body portion preferably has an apertured end wall, the apertures in the end wall allowing air to pass from the air inlet into the body portion and thence into the pipe.

The body portion and the lid may be made of a plastics material. The plastics material enables the body portion and the lid easily to be moulded. The sealing means may similarly be made from a plastics material. The actual seals are preferably made from a rubber material. The rubber material may be that used in known valves.

The valve will usually be such that the body portion fits over the pipe. If desired however the body portion may fit inside the pipe. The body portion will usually fit to the pipe with a push fit.

The valve may include a spacer seal for enabling the body portion to locate in a larger diameter pipe. For example, the spacer seal may enable the body portion to fit over a 3 inch (82 mm) pipe or to fit inside a 4 inch (110 mm) pipe. The spacer seal may be a sleeve. The sleeve may be a rubber sleeve or the sleeve may be made of another material. The sleeve may advantageously have ribs on either side. The ribs may be effective to give a good seal without presenting too much area which could provide too much friction as the body portion is slid into the sleeve and as the sleeve is slid into the pipe.

The valve may include cover means for covering at least a part of the valve. Thus the cover means may cover a top part of the valve.

The cover means may be made from a foamed plastics material. The foamed plastics material may be polystyrene. The foamed plastics material or other material from which the cover means is made may give thermal insulation to the valve and thus stop the sealing means from icing up in freezing conditions due to condensation being present in the valve.

The valve may be made in any desired sizes for fitting to various sized pipes. Thus, for example, the body portion may be made to fit to pipes which are 1.25, 1.5, 2, 3 or 4 inches in diameter. These pipe diameter sizes correspond to 38 mm, 43 mm, 50–55 mm, 70–82 mm and 110 mm pipe diameter sizes. The pipe diameter sizes of 38 mm and 43 mm may be produced in ranges which extend to either side of these stated values.

Embodiments of the invention will now be described solely by way of example and with reference to the accompanying drawings in which.

Figure 2:
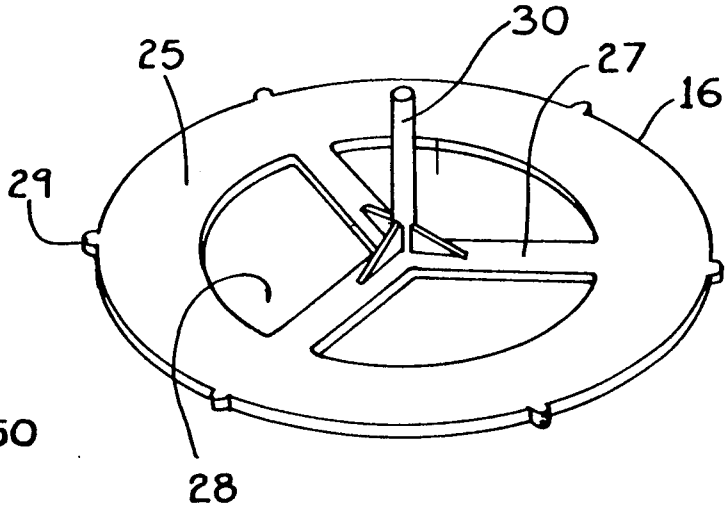
FIG. 2 is a perspective view showing sealing means employed in the valve shown in FIG. 1.
Figure 1:
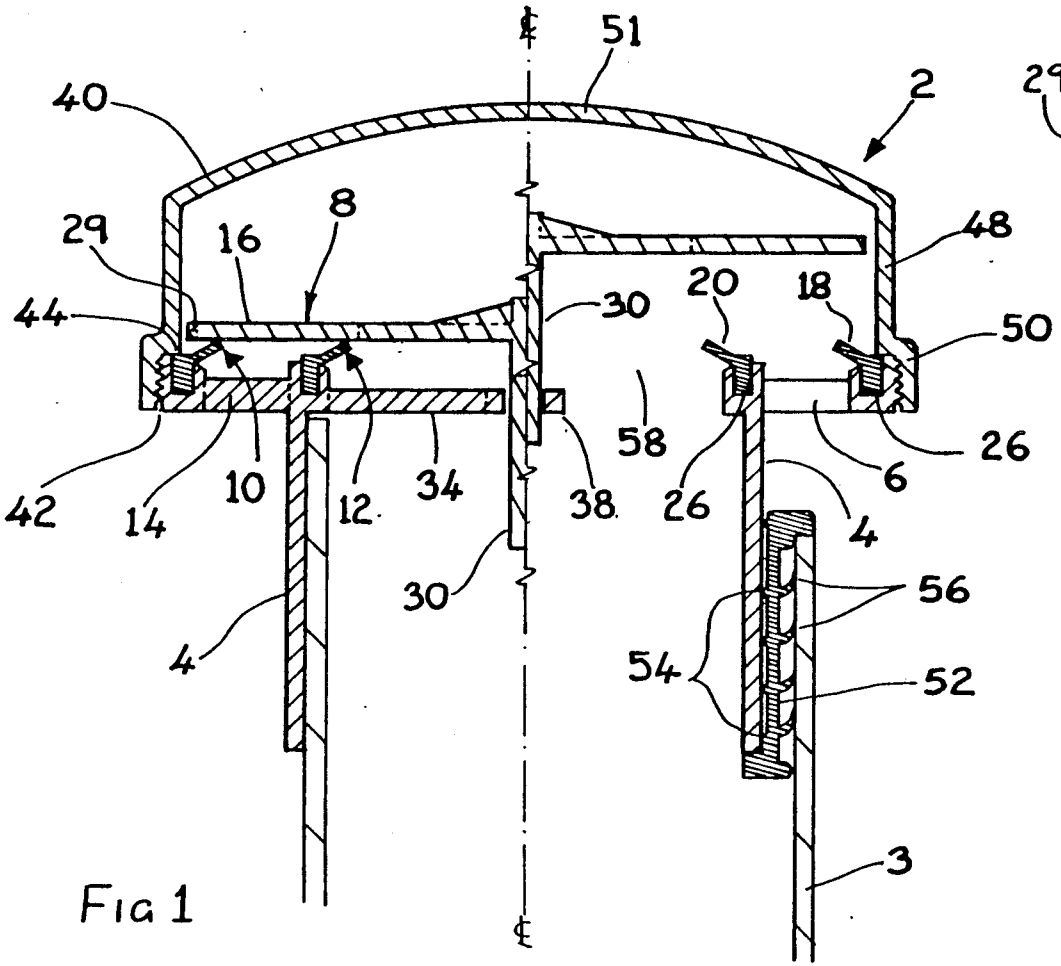
FIG. 1 is a longitudinal section through a first one way air admittance valve.

Referring to FIGS. 1 and 2, there is shown a one way air admittance valve 2 for admitting air into a pipe 3. The valve 2 comprises a body portion 4 for fitting to the pipe 3 as shown. The valve 2 also comprises a number of air inlet ports 6 in the body portion 4. There may be one, two, three, four or more of the inlet ports 6 as may be desired.

The valve 2 further comprises sealing means 8 which is longitudinally movable between a first position which is shown on the left side of FIG. 1 and in which the sealing means 8 seals the inlet ports 6, and a second position which is shown on the right side of FIG. 1 and in which the inlet ports 6 are open for the admittance of air into the pipe 3. The valve 2 is such that only one sealing means 8 is employed for sealing all of the inlet ports 6. The sealing means 8 is such that it seals at two separate areas 10, 12. These two separate areas 10, 12 are radially spaced apart as shown and they are generally positioned inwardly and outwardly of the inlet ports 6 as shown.

The inlet ports 6 are formed in a flanged part 14 of the body portion 4.

The sealing means 8 comprises a rigid sealing disc 16. The disc 16 engages with a pair of seals 18,20 which are mounted in the body portion 4 and which are radially spaced apart, whereby the piston 16 effects a seal at the two separate areas 10,12. More specifically, air at the inlet ports 6 is prevented by the seal 20 from passing to the centre of the sealing means 8, and air at the inlet ports 6 is prevented by the seal 18 from passing to the periphery of the sealing means 8.

The seals 18, 20 are circular lipped seals as shown and they each fit in a groove 26 in the body portion 4. The seals 18, 20 each project from their groove 26 inwardly into the body portion 4 as shown in FIG. 1.

The disc 16 has a flange 25 and three webs or spokes 27 which define three apertures 28. The disc 16 has peripheral ribs 29 which act as friction reducing guides as the disc 16 moves up and down during operation of the valve 2.

The disc 16 has a guide member in the form of a guide rod 30. The guide rod 30 extends into an aperture 32 formed in a transverse part of the body portion 4. The transverse part 34 may be formed by a spoke arrangement 38 similar to the spokes 27 of the piston 8.

The body portion 4 is closed by a lid 40. The lid 40 is a screw lid which fits to the flanged part 14 of the body portion 4. More specifically, the lid 40 screws over the outside of the flanged part 14 by virtue of the illustrated mating screw threads 42. As the lid 40 is screwed down, it engages a top part 44 of the seal 18 to effect a good seal at this point.

The lid 40 is a relatively flat lid since it only accommodates the disc 16 and its up and down movement. The lid 40 has a first portion 48 and a second and larger diameter portion 50. The lid 40 also has a slightly domed top 51.

The body portion 4 may be provided with a spacer seal in the form of a rubber spacer sleeve 52 for enabling the body portion 4 to fit in a larger pipe 3. Thus, as shown by way of example in FIG. 1, the body portion 4 may fit over a 3 inch (82 mm) soil pipe 3 or inside a 4 inch (110 mm) soil pipe 3. The spacer sleeve 52 has inner and outer ribs 54, 56 respectively.

The body portion 4, the disc 16 and the lid 40 may be moulded from a plastics material. The seals 18, 20 are made from plastics materials of the type usually used in one way air admittance valves for admitting air into pipes.

The valve 2 shown in FIGS. 1 and 2 operates such that when flushing of a water closet has not occurred, there will be a positive pressure in the pipe 3. The disc 16 will then be in its sealing position as shown in the left hand half of FIG. 1. When the water closet is flushed, a negative pressure or vacuum will occur in the pipe 3 and this might drag water from the sealing trap beneath the toilet bowl in the water closet. This is prevented by air entering the pipe 3 through the inlet ports 6 and through apertures 58 formed in the transverse part 34 of the body portion 4. The air can also pass through the apertures 28 into the lid 40. When the flushing ceases, the negative pressure ceases and the piston 6 then returns to its sealing position to stop the escape of unpleasant odours that might otherwise pass up the pipe 3 and escape via the valve 2. The valve 2 gives efficient opening of the valve at low pressure, for example as 10 mm head of water. At the same time, the valve 2 also gives a good seal to stop smells passing through the valve 2. The valve 2 operates to let in a good rush of air and the air passage is not unduly restricted as occurs in some known valves. The valve 2 can be installed on multi-storey buildings which are higher than four storeys. With some known valves, they are not able to be installed on multi-storey buildings higher than four storeys since the valves then do not work satisfactorily.

Figure 4:
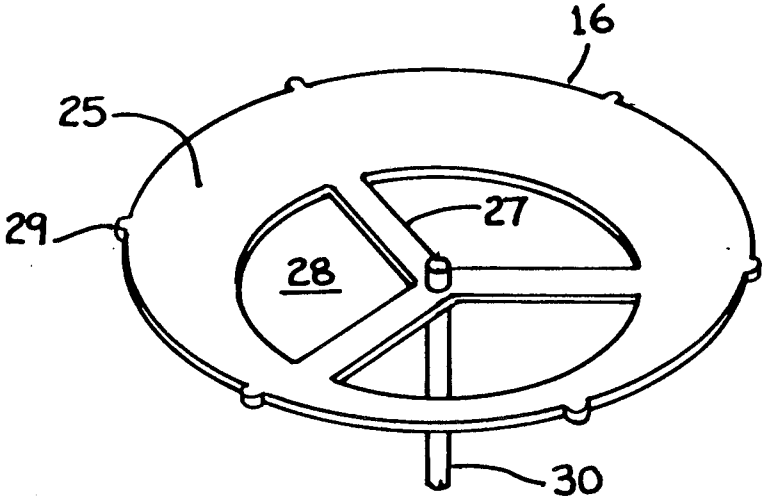
FIG. 4 is a perspective view of sealing means employed in the valve shown in FIG. 3.
Figure 3:
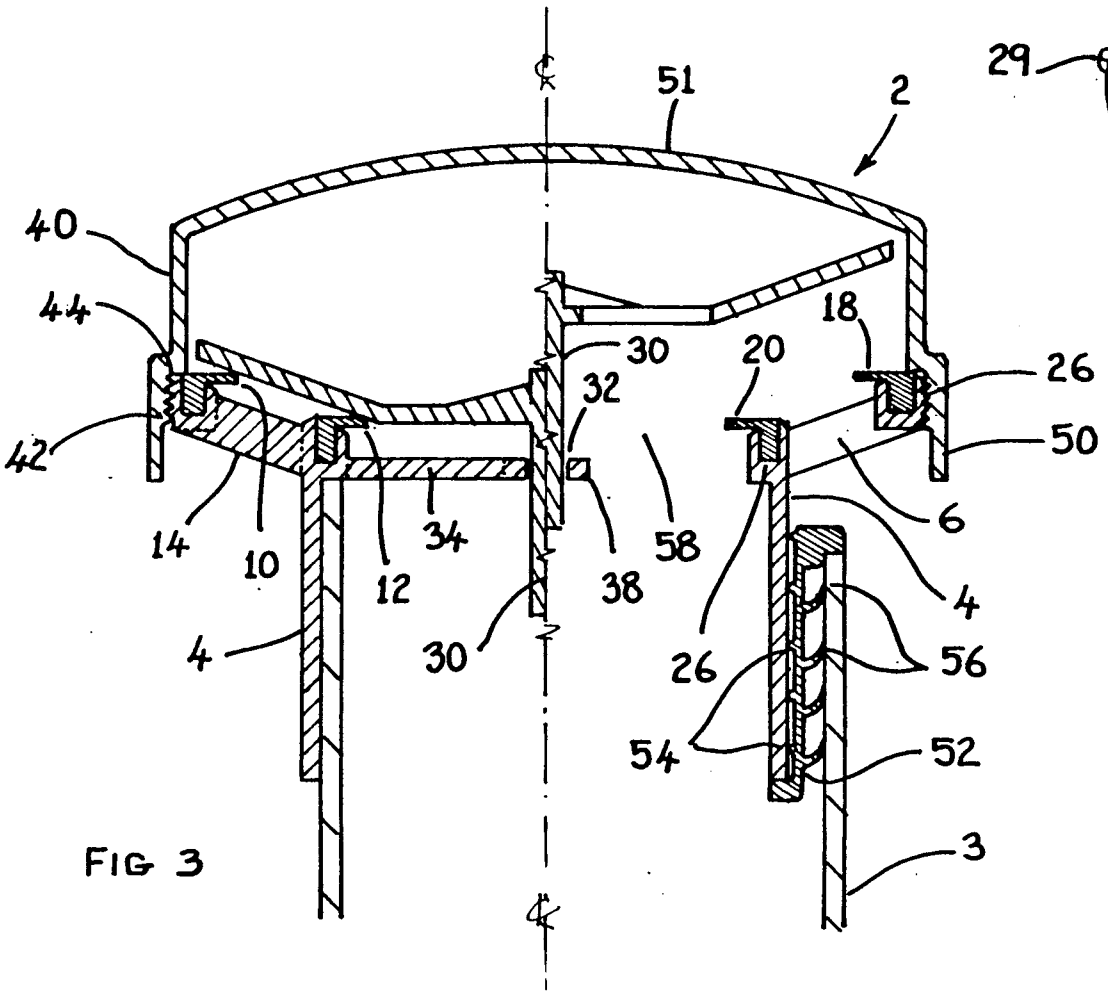
FIG. 3 is a longitudinal section through a second one way air admittance valve.

Referring now to FIGS. 3 and 4, there is shown a second valve 2. Similar parts as in FIGS. 1 and 2 have been given the same reference numerals for ease of comparison and understanding, and their precise construction and operation will not again be given.

In FIGS. 3 and 4, it will be seen that the sealing disc 16 is slightly differently shaped and it is in fact slightly convex. Also, the seals 18, 20 are slightly different. The portion 50 of the lid 40 is slightly deeper than in FIGS. 1 and 2. Furthermore, the flange part 14 slopes as shown.

Figure 5:
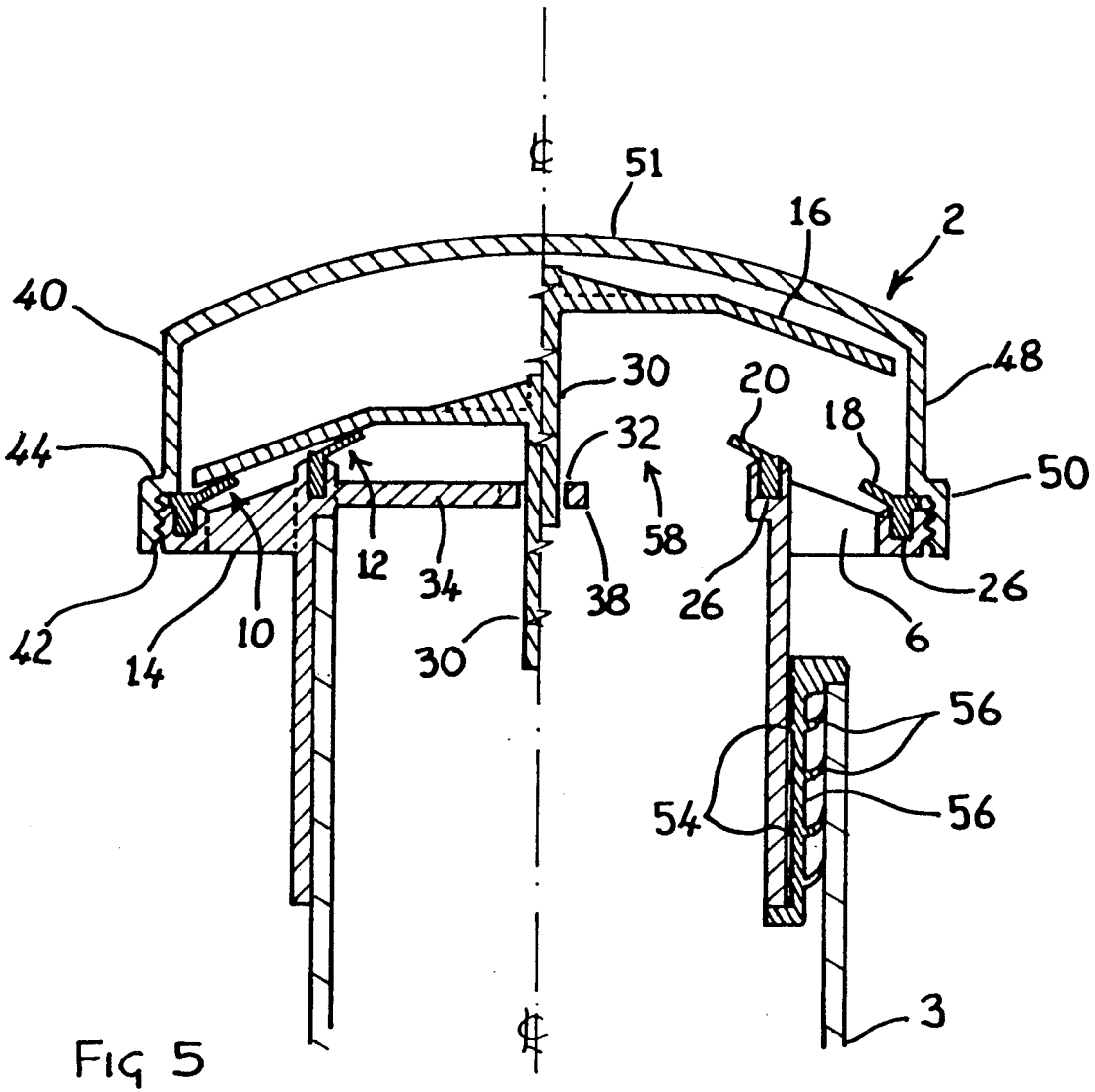
FIG. 5 is a longitudinal section through a third one way air admittance valve.

Referring now to FIG. 5, there is shown a third valve 2. Similar parts as in the previous Figures have again been given the same reference numerals for ease of comparison and understanding, and their precise construction and operation will not again be given.

In FIG. 5, the sealing disc 16 is shown as being slightly concave.

It is to be appreciated that the embodiments of the invention described above with reference to the accompanying drawings have been given by way of example only and that modifications may be effected. Thus, for example, the valves 2 may be made in any desired sizes for fitting to appropriately sized pipes. The pipe 3 need not be a soil pipe and it could be, for example, a waste pipe from a sink, bathroom or other area. Generally, the valves 2 may be fitted to any pipe in which it is required to allow the one way admittance of air.

If desired, the valves 2 may be provided with cover means (not shown). The cover means may cover a top part of the valves 2 and the cover means may be made from a foamed plastics material such for example as polystyrene. The cover means may give some thermal insulation/protection in order to stop the disc 16 freezing up in freezing conditions due to condensation forming in the valves 2.

I claim:

1. A one way air admittance valve for admitting air into a pipe, which valve comprises a body portion for fitting to the pipe, at least one air inlet port in the body portion, and rigid sealing means which is longitudinally movable between a first position in which it seals the air inlet port and a second position in which the air inlet port is open for the admittance of air into the pipe, the valve being such that there is only one sealing means for all of the air inlet ports, and the sealing means being such that it seals at two separate areas by engaging with a pair of lip seals which are mounted on the body portion and which are radially spaced apart by being positioned inwardly and outwardly of the air inlet port.

2. A one way air admittance valve according to claim 1 in which the sealing means comprises a sealing disc.

3. A one way air admittance valve according to claim 1 and including a guide member for guiding the longitudinal movement of the sealing means.

4. A one way air admittance valve according to claim 1 in which the body portion has an open top which is closed by a lid.

5. A one way air admittance valve according to claim 1 in which the or each air inlet port is formed in an outwardly extending flanged part of the body portion, and in which the body portion has an apertured end wall, the apertures in the end wall allowing air to pass from the air inlet into the body portion and thence into the pipe.

6. A one way air admittance valve according to claim 5 and including a spacer seal for enabling the body portion to locate in a larger diameter pipe.

7. A one way air admittance valve according to claim 1 and including cover means for covering a top part of the valve, the cover means being made from a foamed plastics material.

* * * * *